US006971251B2

(12) United States Patent
Brost

(10) Patent No.: US 6,971,251 B2
(45) Date of Patent: Dec. 6, 2005

(54) INTEGRATED CONDENSER/RECEIVER

(75) Inventor: Viktor Brost, Aichtal (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 11/006,172

(22) Filed: Dec. 6, 2004

(65) Prior Publication Data

US 2005/0120739 A1 Jun. 9, 2005

(30) Foreign Application Priority Data

Dec. 6, 2003 (DE) ..... 103 57 176

(51) Int. Cl.[7] ..... F25B 39/04

(52) U.S. Cl. ..... 62/509

(58) Field of Search ..... 62/473, 509, 512, 62/524, 525; 162/132

(56) References Cited

U.S. PATENT DOCUMENTS 5,927,102 A * 7/1999 Matsuo et al. ..... 62/509

6,470,704 B2 * 10/2002 Shibata et al. ..... 62/509

* cited by examiner

*Primary Examiner*—Melvin Jones
(74) *Attorney, Agent, or Firm*—Wood, Phillips, Katz, Clark & Mortimer

(57) ABSTRACT

An integrated condenser/receiver includes a multi-pass heat exchanger core, an elongated receiver housing, and a refrigerant conduit to direct refrigerant between the receiver housing and the multi-pass heat exchanger core. The heat exchanger core includes an elongate header extending along an axis, a plurality of tubes extending parallel to each other and transverse to the axis to direct a refrigerant through the core, with the tubes spaced along the header and having ends received therein to direct refrigerant to and from the header, and at least one baffle in the header to separate the header into a first portion that receives refrigerant from a first set of the tubes and a second portion that directs refrigerant to a second set of the tubes. Each of the set of tubes defines a refrigerant pass through the core. The receiver housing is mounted to the core, with the second set of tubes located between the receiver housing and the first set of tubes. The receiver housing includes a first port connected to the second portion. The refrigerant conduit is connected to the first portion and to the receiver housing to direct refrigerant between the first portion and the receiver housing.

18 Claims, 5 Drawing Sheets

INTEGRATED CONDENSER/RECEIVER

FIELD OF THE INVENTION

This invention relates to integrated condenser/receivers and in more particular applications, to multi-pass integrated condenser/receivers used in the air conditioning systems of motor vehicles.

BACKGROUND OF THE INVENTION

The integration of a multi-pass condenser with a receiver is known, and is sometimes used in the air conditioning systems of motor vehicles because such integration can provide a relatively compact construction and can minimize the number of refrigerant lines and connections in the air conditioning system. It is also known in such systems to locate the receiver in the refrigerant flow path in at least one of two ways. In one type of integrated condenser/receiver, the receiver is located downstream of all of the passes of the condenser. In the other type of integrated condenser/receiver, the receiver is located downstream of at least one pass of the condenser and upstream of at least one pass of the condenser. Often, in the latter type construction, the pass of the condenser located downstream of the receiver serves as a subcooling or super-cooling pass of the condenser because of the ability of the receiver to separate the liquid phase refrigerant from the gas phase refrigerant and to direct liquid phase refrigerant to the downstream pass of the condenser. An example of an integrated condenser/receiver is shown in EP 769 666 A1, wherein the tubes of the heat exchanger extend vertically between a pair of horizontally extending manifolds or headers, with the receiver extending vertically, parallel to the tubes. The vertical extension of the receiver is desirable for the separation of the liquid and gas phases of the refrigerant. Another example of an integrated condenser/receiver is shown in EP 974 793 A2, wherein the tubes of the heat exchanger extend horizontally between a pair of vertically extending manifolds or headers, with the receiver extending horizontally parallel to the heat exchanger tubes and below the core of the condenser and downstream of all of the passes of the condenser. Both of the prior examples utilize a receiver that is removably mounted to one of the headers of the condenser via a brazed on connecting/mount block.

While known integrated condenser/receivers may perform well for their desired applications, there is always room for improvement. For example, there is a continuing desire to provide compact integrated condenser/receiver designs that also provide ease of manufacture. In this regard, in some cases it is often desirable to form the integrated condenser/receiver as a none separable soldered or brazed assembly.

SUMMARY OF THE INVENTION

In accordance with one feature of the invention, an integrated condenser/receiver is provided for use in a vehicular air conditioning system. The condenser/receiver includes a multi-pass heat exchanger core, an elongated receiver housing, and a refrigerant conduit to direct refrigerant between the receiver housing and the multi-pass heat exchanger core. The multi-pass heat exchanger core includes an elongate header extending along an axis, a plurality of tubes extending parallel to each other and transverse to the axis to direct a refrigerant through the core, with the tubes spaced along the header and having ends received therein to direct refrigerant to and from the header, and at least one baffle in the header to separate the header into a first portion that receives refrigerant from a first set of the tubes and a second portion that directs refrigerant to a second set of the tubes. Each of the set of tubes defines a refrigerant pass through the core. The elongate receiver housing extends parallel to the tubes and transverse to the axis. The receiver housing is mounted to the core, with the second set of tubes located between the receiver housing and the first set of tubes. The receiver housing includes a first port connected to the second portion to direct refrigerant between the second portion and the receiver housing. The refrigerant conduit is connected to the first portion and to the receiver housing to direct refrigerant between the first portion and the receiver housing.

In one feature, the conduit extends transverse to the tubes and parallel to the axis.

According to one feature, the first port is connected to an end of the header, with the end being open to the second portion.

In one feature, the conduit is located within the header. In a further feature, the conduit extends from the first portion into the second portion through an opening in the baffle. In one feature, the header has a larger cross section over a length that includes the conduit than another length of the header that does not include the conduit. According to one feature, the conduit is located outside of the header. According to a further feature, the conduit has a first end connected to the first portion adjacent the baffle, and a second end connected to the receiver housing.

In one feature, the receiver housing includes an inner housing and an outer housing, with the inner and outer housings defining a refrigerant flow channel therebetween. A second port is defined in one of the inner and outer housings.

In one feature, the inner and outer housings are elongate and arranged coaxial to each other.

According to one feature, the integrated condenser/receiver further includes a desiccant charge and a filter, with the desiccant charge and the filter located within the receiver housing.

In one feature, the desiccant charge and the filter are located within the inner housing.

According to one feature, the desiccant charge is located within the inner housing, and the filter is located inside of the outer housing and outside of the inner housing.

In one feature, the second port is defined at a first end of the inner housing, and the filter is arranged at a second end of the inner housing opposite the first end whereby refrigerant flow into the inner housing, passes through the filter, reverses direction, and flows through the flow channel to the first port.

In one feature, the first port is formed in the other of the inner and outer housings, and the second port and the first port are aligned openings formed in side walls of the inner and outer housings.

In one feature, one of the first port and the second port is formed in an end of the outer housing and the other of the first port and the second port is formed in a side wall of the outer housing.

According to one feature, the inner and outer housings and the header are cylindrical in shape, and the tubes are flattened tubes.

In accordance with one feature, the axis extends horizontally, and the tubes and the receiver housing extend vertically with the core mounted in an operative position.

Other objects, features, and advantages of the invention will become apparent from a full reading of the entire specification, including the appended claims and drawings.

DETAILED DESCRIPTION OF THE PREFERRED EMBODIMENTS

Figure 1:
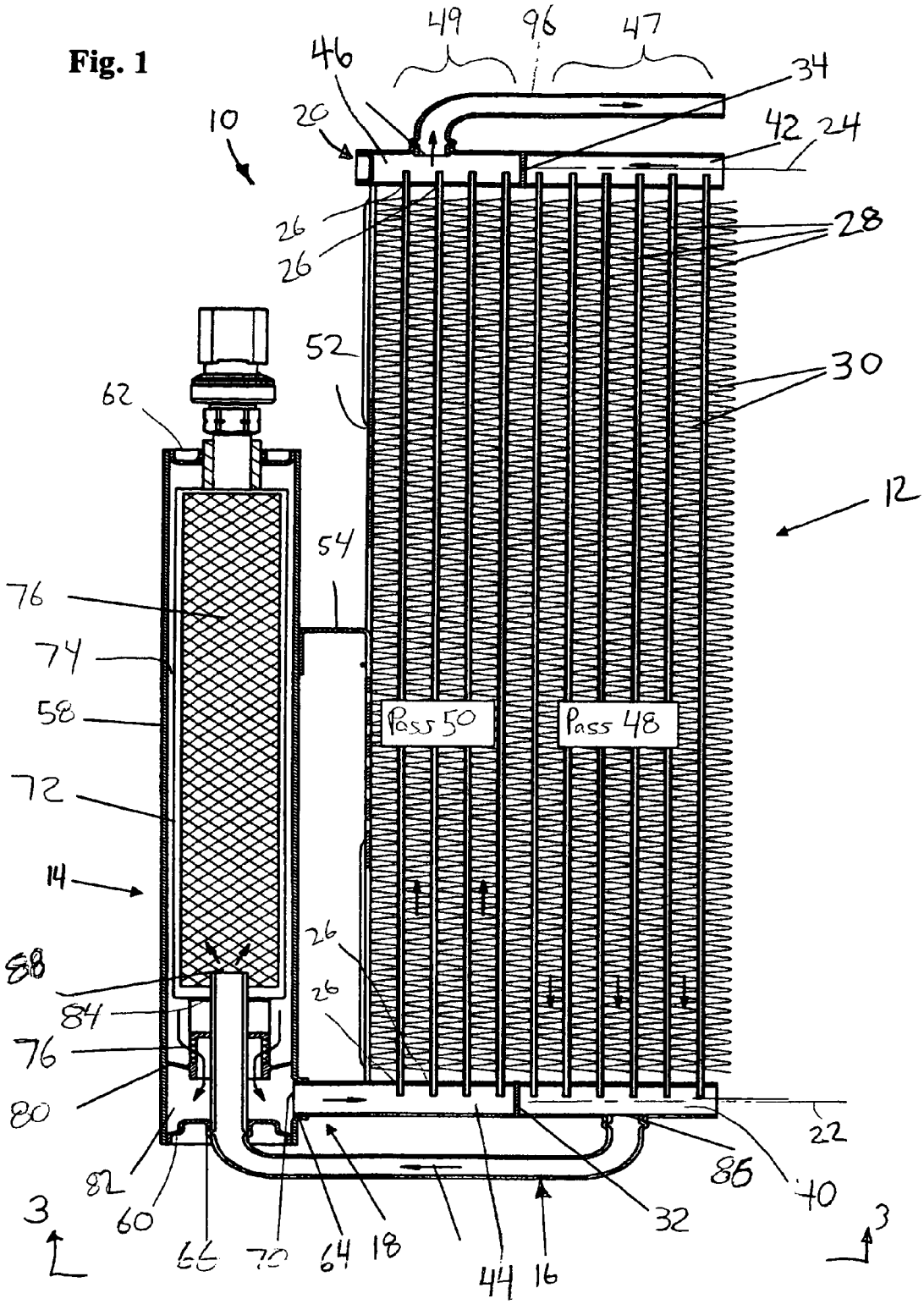
FIG. 1 is a sectioned elevation view showing part of an integrated condenser/receiver embodying the present invention.

In reference to FIG. 1, an integrated condenser/receiver 10 is provided for use in a vehicular air conditioning system. The condenser/receiver 10 includes a multi-pass heat exchanger core 12, an elongate receiver housing 14, and a refrigerant conduit 16 connected to the core 12 and the receiver housing 14 to direct refrigerant between the core 12 and the receiver housing 14.

In the illustrated embodiment, the core 12 includes a pair of elongate manifolds or headers 18 and 20 that extend along respective horizontal axes 22 and 24. Preferably, the headers 18 and 20 are provided in the form of horizontally extending cylindrical tubes, each of which includes a plurality of spaced tube slots 26 along its length that receive ends of a plurality of tubes 28 that extend between the headers 18 and 20. Preferably, the tubes 28 are flattened tubes that extend parallel to each other and transverse to the axis so as to direct the refrigerant vertically through the core 12 to and from the headers 18 and 20. A plurality of fins 30, which are preferably serpentine, extend between the tubes 28 so that a cooling fluid, typically air, may be directed through the fins 30 for the transfer of heat from the refrigerant to the cooling fluid. A pair of axially aligned baffles 32 and 34 are provided in the headers 18 and 20, respectively, to divide the interiors of the headers 18 and 20 into respective first and second portions 40, 42 and 44, 46, with the first portions 40 and 42 directing refrigerant through a first set 47 of the tubes 28 which define a first refrigerant pass 48, and the second portions 44 and 46 directing refrigerant through a second set 49 of the tubes 28 defining a second refrigerant pass 50. Preferably, the core 12 further includes a side piece 52 extending between the headers 18 and 20 overlying an outermost one of the fins 30 to reinforce the core 12. In this regard, a bracket 54 can be provided extending from the side piece to the receiver housing 14 to assist in mounting the receiver housing 14 to the core 12.

The receiver housing 14 is mounted to the core 12 with the second set of tubes 49 located between the receiver housing 14 and the first set of tubes 47. The receiver housing 14 extends parallel to the tubes 28 and transverse to the axes 22 and 24, and is preferably provided in the form of a cylindrical outer housing 58 with a pair of end caps 60 and 62 closing its respective ends. The housing 14 further includes a first port 64 located in the cylindrical side wall of the outer housing 58 and a second port 66 located in the end cap 60, with the first port 64 acting as a refrigerant outlet and the second port 66 acting as a refrigerant inlet in the illustrated embodiment. However, it should be understood that should the direction of the refrigerant flow through the integrated condenser/receiver 10 be reversed, the first port 64 would be an inlet and the second port 66 would be an outlet. The first port 64 is connected to the second portion 44 of the header 18 to direct refrigerant between the second portion 44 and the receiver housing 14. In this regard, it is preferred that the port 64 be provided in the form of a flanged opening that is mounted directly to an open end 70 of the header 18.

Preferably, the receiver housing 14 further includes an inner housing 72 in the form of an elongate cylindrical wall that is coaxial with the outer housing 58, with the inner housing 72 and the outer housing 58 defining a refrigerant flow channel 74 therebetween. Preferably, a desiccant charge 76 in the form of a suitable dryer is provided within the inner housing 72, and a filter 78 is provided inside the outer housing 58 and outside the inner housing 72 downstream of the desiccant charge 76. A separating wall or annular seal 80 is located adjacent the filter 78 on the downstream side to restrict the flow of refrigerant such that all, or nearly all of the refrigerant flows through the filter 78 before passing to a lower chamber 82 defined between the wall 80 and cap 60. A third port 84 is provided in a bottom wall of the inner housing 72 and acts as an inlet for receiving refrigerant into the interior of the inner housing 72.

The refrigerant conduit 16 is illustrated in FIG. 1 in the form of a cylindrical tube having a pair of ends 86 and 88, with the end 86 received in a flanged opening in the first portion 40 of the header 18 adjacent the baffle 32, and the end 88 extending upward through the ports 66 and 84. Thus, refrigerant is received into the end 86 from first portion 40 and is directed by the conduit 16 to the receiver housing 14 to exit from the end 88 into the interior of the inner housing 72.

Figure 2:
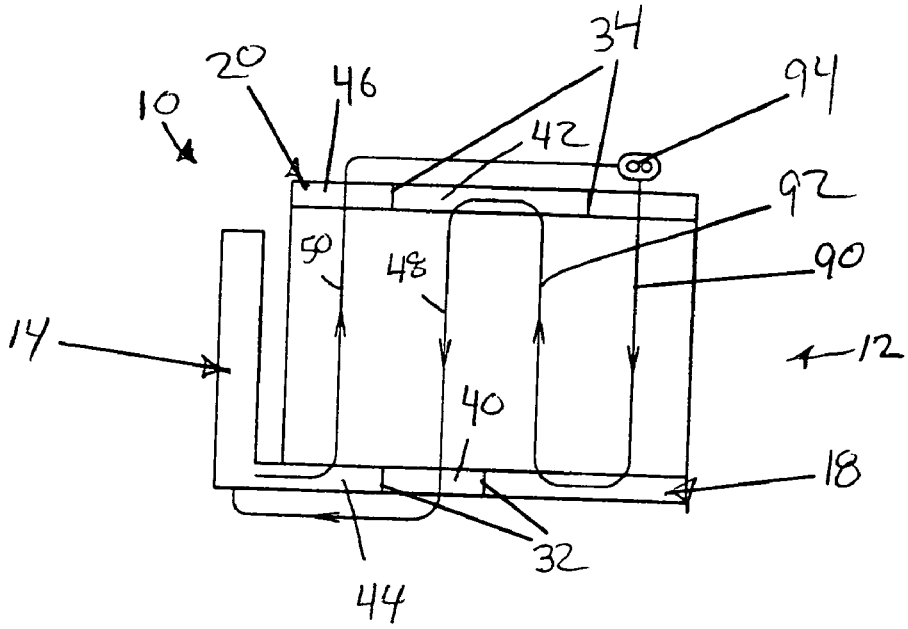
FIG. 2 is a diagrammatic representation of the integrated condenser/receiver of FIG. 1.

As seen in FIG. 2, the core 12 of the integrated condenser/receiver 10 can include one or more additional baffles 32 and 34 in their respective headers 18 and 20 so as to divide the interior of the headers 20 and 22 into additional portions and thereby create additional refrigerant passes 90 and 92 through the core 12. With reference to the arrowed flow lines in both FIGS. 1 and 2, the refrigerant enters the condenser/receiver 10 via, for example, an inlet and outlet port block 94 and then is ultimately directed through one or more of the passes 90, 92 to the first portion 42 of the header 20. The refrigerant then flows to the first portion 40 of the header 18 through the tubes 47 of the pass 48 and then flows from the first portion 40 to the receiver housing 14 via the conduit 16. The refrigerant then flows upward through the desiccant charge 76 in the interior of the inner housing 72, exits out of the inner housing 72 and reverses flow direction to flow downward through the passage 74 to the filter 78. After passing through the filter 78, the refrigerant flows through the port 64 into the second portion 44 where it is directed upward through the tubes 49 of the second pass 50 into the second section 46 of the header 20 before being directed via a conduit 96 back to the block 94 where it is directed to the remainder of the air conditioning system. Preferably, the refrigerant is sub-cooled or super-cooled as its moves through the pass 50.

Figure 3:
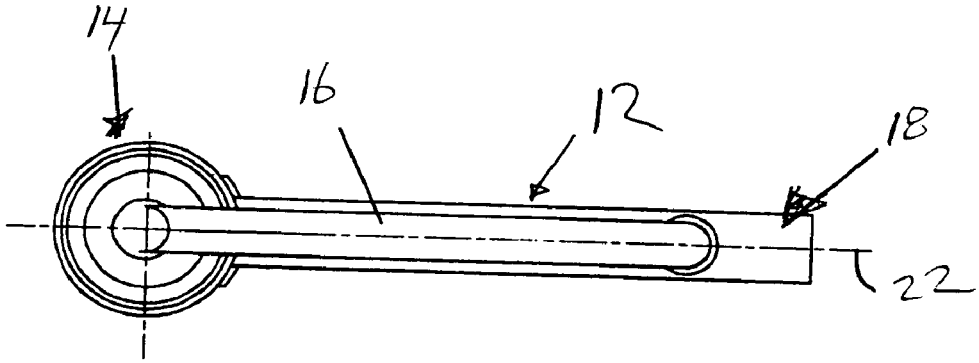
FIG. 3 is a view taken from line 3—3 in FIG. 1.
Figure 4:
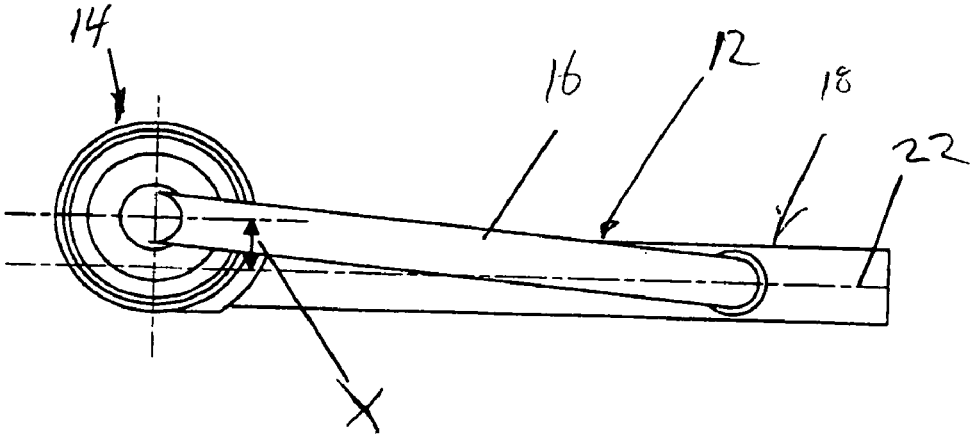
FIG. 4 is a view similar to FIG. 3 but showing another form of the integrated condenser/receiver of FIG. 2.

With reference to FIG. 3, in one form, the center of the refrigerant housing 14 is aligned with the axis 22 such that the outside diameter of the housing 14 extends both in front and in back of the front and back planes or faces of the core 12. However, as seen in FIG. 4, in some applications, it may be desirable to offset the center of the housing 14 from the axis 22 by a distance X so that the outer diameter of the housing 14 biased toward the plane of either the front or back of the core 12.

Figure 5:
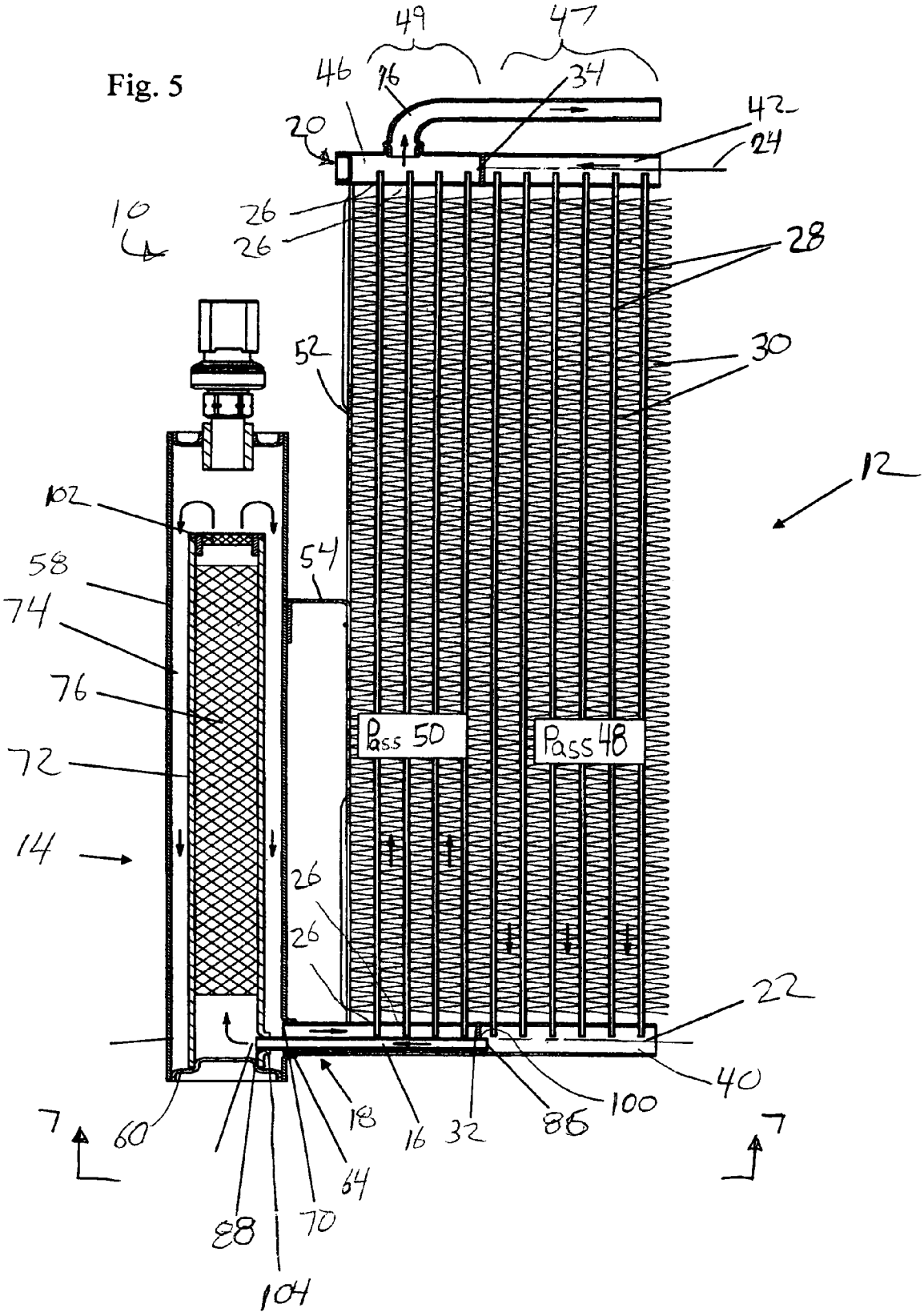
FIG. 5 is a sectioned elevation view showing part of another integrated condenser/receiver embodying the present invention.
Figure 6:
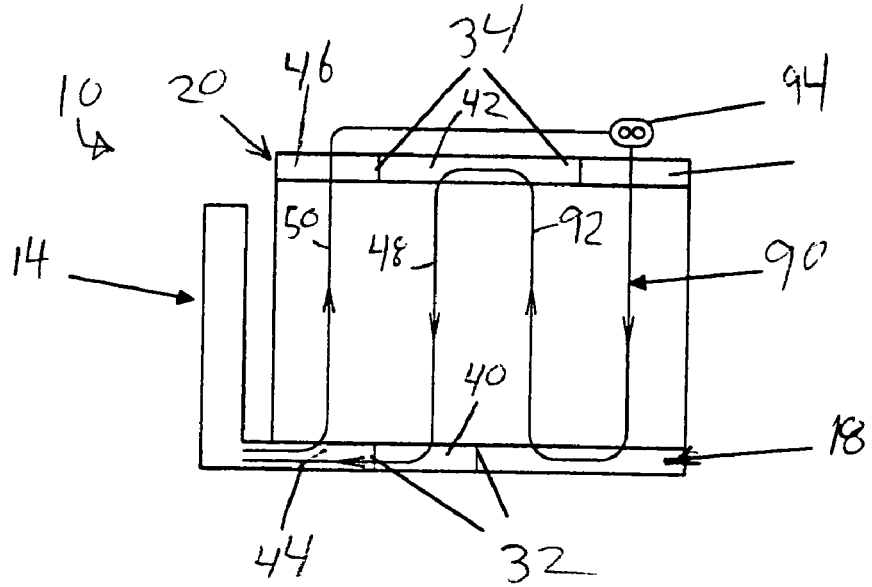
FIG. 6 is a diagrammatic representation of the integrated condenser/receiver of FIG. 5.
Figure 7:
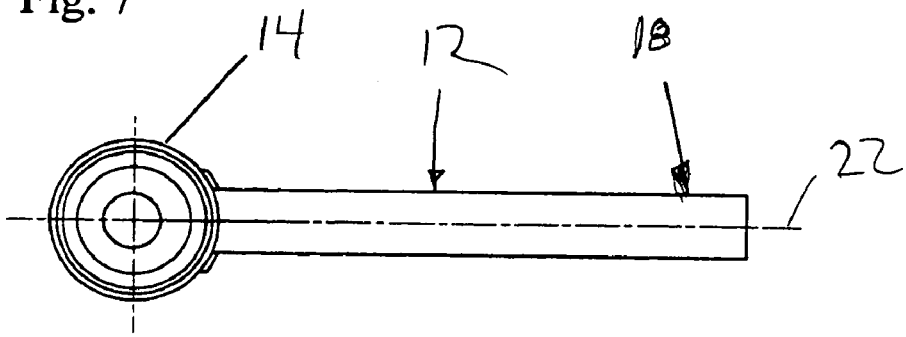
FIG. 7 is a view taken from 7—7 of FIG. 5.
Figure 8:
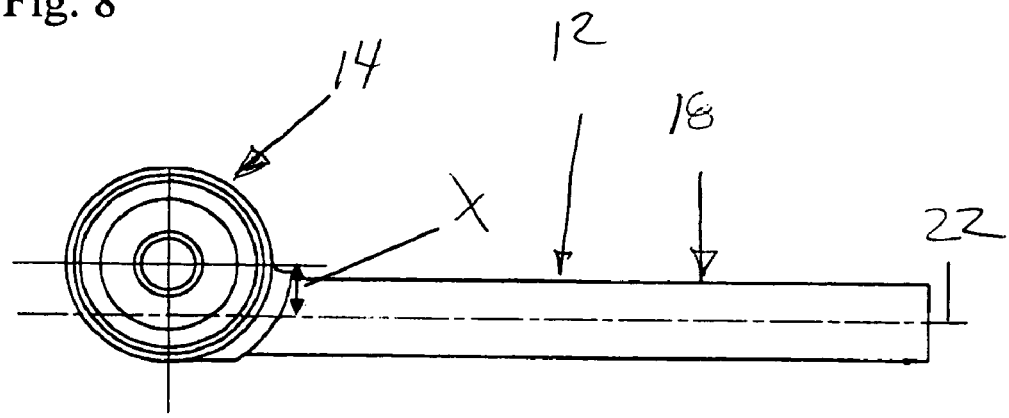
FIG. 8 is a view similar to FIG. 7 showing another form of the integrated condenser/receiver of FIG. 5.

With reference to FIGS. 5–9, another form of the integrated condenser/receiver 10 is shown, with like reference numbers indicating like components. In this embodiment, with reference to FIG. 5, the refrigerant conduit 16 is mounted inside the header 18 rather than outside as in FIGS. 1–4. The conduit 16 is preferably a straight cylindrical tube and extends from the first portion 40 to the interior of the receiver housing 14 by passing through the second portion 44 and a conforming opening 100 formed in the baffle 32. While the conduit 16 is shown offset from the center line of the header 18 in FIG. 5, it may be desirable in some embodiments for the conduit 16 to be mounted coaxial with the header 18. The inner housing 72 in this embodiment is provided in the form of a cylindrical tube that has a lower end that is closed by an annular step in the cap 60 and an upper opening that has a filter 102 mounted therein, with the desiccant charge 76 again contained within the housing 72. A port 104, which is preferably flanged, is formed in the side wall of the interior housing 72 and receives the end 88 of the conduit 16. Thus, the refrigerant is directed from the first portion 40 to the interior of the inner housing 72 via the refrigerant conduit 16 and then flows upward through the desiccant charge 72 before passing through the filter 102. The refrigerant then reverses direction and flows downward through at least part of the flow channel 74 before exiting through the port 64 to the second portion 44. The refrigerant then flows through the tubes 49 of the second pass 50 before leaving the integrated condenser/receiver 10. Again, refrigerant is preferably sub-cooled or super-cooled in the pass 50. As seen in FIGS. 7 and 8, in this embodiment as with the embodiment of FIGS. 1–4, the housing 14 can be either mounted so that its center is aligned with the axis 22, or so that its center is offset by the distance X from the axis 22 so that the outside diameter is biased toward the plane or face of either the front or back of the core 12.

Figure 9:
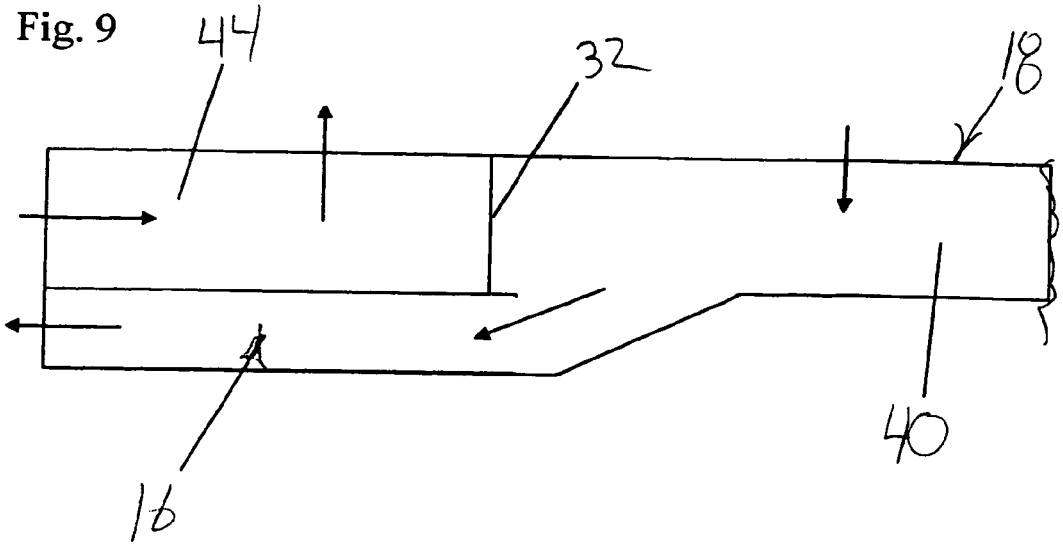
FIG. 9 is a somewhat diagrammatic representation of yet another form for the integrated condenser/receiver of FIG. 5.

FIG. 9 shows an alternate form of the embodiment of FIGS. 5 and 6 wherein the header 18 is provided with an enlarged cross section over the length of the header through which the refrigerant conduit 16 extends. In this regard, the enlarged cross section can allow for the conduit 16 to be easily incorporated, and can also prevent any unnecessary pressure loss in the refrigerant flow returning to the second portion 44 that might otherwise occur if the cross section was reduced by the diameter of the conduit 16.

While any suitable construction may be employed, in the illustrated embodiments it is preferred that the components of the integrated condenser/receiver 10 be joined by a suitable solder or brazing technique to form an inseparable assembly. In this regard, it should be appreciated that the compact assemblies provided by the embodiments herein lend themselves to such techniques.

It should also be appreciated that the use of the conduit 16 allows for the receiver housing 14 to be mounted to the side of the core 12 so as not to interfere with the air flow through the core 12. However, in some applications it may be desirable to mount the receiver housing 14 so that it at least partially overlaps one of the faces of the core 12.

It should further be appreciated that the horizontal orientation of the headers 18 and 20 can particularly be suitable for combination with a radiator or other heat exchangers of a motor vehicle, which also have horizontally arranged headers above and below vertically extending tubes.

What is claimed is:

1. An integrated condenser/receiver for use in a vehicular air conditioning system, the condenser/receiver comprising:
- a multi-pass heat exchanger core including
  - an elongate header extending along an axis,
  - a plurality of tubes extending parallel to each other and transverse to said axis to direct a refrigerant through the core, said tubes spaced along said header and having ends received therein to direct refrigerant to and from said header, and
  - at least one baffle in said header to separate said header into a first portion that receives refrigerant from a first set of said tubes and a second portion that directs refrigerant to a second set of tubes, each of said sets defining a refrigerant pass through said core;
- an elongate receiver housing extending parallel to said tubes and transverse to said axis, said receiver housing mounted to said core with said second set of tubes located between said receiver housing and said first set of tubes, said receiver housing including a first port connected to said second portion to direct refrigerant between the second portion and the receiver housing; and
- a refrigerant conduit connected to said first portion and to said receiver housing to direct refrigerant between the first portion and the receiver housing.

2. The integrated condenser/receiver of claim 1 wherein said conduit extends transverse to said tubes and parallel to said axis.

3. The integrated condenser/receiver of claim 1 wherein said first port is connected to an end of said header, the end being open to the second portion.

4. The integrated condenser/receiver of claim 1 wherein said conduit is located within said header.

5. The integrated condenser/receiver of claim 4 wherein said conduit extends from said first portion into said second portion through an opening in said baffle.

6. The integrated condenser/receiver of claim 4 wherein said header has a larger cross section over a length that includes said conduit than another length of the header that does not include said conduit.

7. The integrated condenser/receiver of claim 1 wherein said conduit is located outside of said header.

8. The integrated condenser/receiver of claim 7 wherein said conduit has a first end connected to said first portion adjacent said baffle, and a second end connected to said receiver housing.

9. The integrated condenser/receiver of claim 1 wherein the receiver housing comprises an inner housing and an outer housing, the inner and outer housings define a refrigerant flow channel therebetween, a refrigerant second port is defined in one of said inner and outer housings.

10. The integrated condenser/receiver of claim 9 wherein said inner and outer housings are elongate and arranged coaxial to each other.

11. The integrated condenser/receiver of claim 9 further comprising a desiccant charge and a filter, the desiccant charge and the filter located within said receiver housing.

12. The integrated condenser/receiver of claim 11 wherein the desiccant charge and the filter are located within said inner housing.

13. The integrated condenser/receiver of claim 11 wherein the desiccant charge is located within said inner housing, and said filter is located inside of said outer housing and outside of said inner housing.

14. The integrated condenser/receiver of claim 11 wherein said second port is defined at a first end of said inner housing, and said filter is arranged at a second end of said inner housing opposite the first end whereby refrigerant flows into the inner housing, passes through the filter, reverses direction, and flows through the flow channel to the port.

15. The integrated condenser/receiver of claim 10 wherein the first port is formed in the other of said inner and outer housings, and the second port and first port are aligned openings formed in side walls of the inner and outer housings.

16. The integrated condenser/receiver of claim 10 wherein one of the second port and the first port is formed in an end of said outer housing and the other of the second port and the first port is formed in a side wall of the outer housing.

17. The integrated condenser/receiver of claim 10 wherein the inner and outer housings and the header are cylindrical in shape, the tubes are flattened tubes.

18. The integrated condenser/receiver of claim 1 wherein said axis extends horizontally, and said tubes and said receiver housing extend vertically with the core mounted in an operative position.

* * * * *